US006211140B1

(12) United States Patent
Sivik et al.

(10) Patent No.: US 6,211,140 B1
(45) Date of Patent: Apr. 3, 2001

(54) CATIONIC CHARGE BOOSTING SYSTEMS

(75) Inventors: Mark Robert Sivik, Fort Mitchell, KY (US); Ellen Schmidt Baker, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/361,393

(22) Filed: Jul. 26, 1999

(51) Int. Cl.[7] ..... C11D 1/645
(52) U.S. Cl. ..... 510/515; 510/504
(58) Field of Search ..... 510/504, 516, 510/515

(56) References Cited

U.S. PATENT DOCUMENTS 5,405,542 * 4/1995 Trinh et al. ..... 252/8.8
5,824,635 * 11/1999 Keys ..... 510/433
5,977,055 * 11/1999 Trinh et al. ..... 510/515

FOREIGN PATENT DOCUMENTS 0 803 498 10/1997 (EP) ..... C07C/219/06
WO 98/12292 3/1998 (WO) ..... C11D/3/00
WO 00/21918 4/2000 (WO) ..... C07C/219/06

* cited by examiner

*Primary Examiner*—John Hardee
(74) *Attorney, Agent, or Firm*—Richard S. Echler, Sr.; Kim W. Zerby; Steven W. Miller

(57) ABSTRACT

The present invention relates to fabric care and fabric softener compositions which comprise:

a) from about 2% by weight, of a cationic fabric softening active;

b) at least about 0.2% by weight, of a cationic charge boosting system; and c) the balance carriers and other adjunct ingredients wherein the cationic charge booster system is the admixture which results from the preparation of a acylated di-quaternary ammonium wherein less than full equivalents of reactants are used in at least one step. The resulting admixture of di-amines, acylated diamines, and acylated quaternized diamines provides a superior charge boosting system which allows the use of fabric softening active which normally have insufficient cationic charge character for effective fabric softness activity.

18 Claims, No Drawings

CATIONIC CHARGE BOOSTING SYSTEMS

FIELD OF THE INVENTION

The present invention relates to fabric softener compositions wherein the performance of the fabric softener active is enhanced by the presence of a cationic charge booster system. The present invention also relates to methods for providing enhanced fabric conditioning benefits to fabric by contacting said fabric with a composition comprising a quaternary ammonium fabric softener active and one or more cationic charge boosting compounds.

BACKGROUND OF THE INVENTION

Consumers have come to expect clean, freshened, static-free, cling-free fabric after the laundry cycle. Fabric softeners, whether added at the laundry rinse stage or at the automatic dryer stage, have become a means for providing fabric, especially clothing, with direct enhancement of these properties. One important class of fabric softener actives comprises Diester and Diamide Quaternary Ammonium (DEQA) compounds which typically can comprise mono-, di-, or tri- functional amines (e.g. diethanol amine) which are converted to the corresponding esters or amides then fully or partially quaternized. Manipulation of the acyl moiety combined with the mono-, di-, or tri- functional amines have led to DEQA's which are effective fabric softener active suitable for use in dryer added or rinse added fabric softener compositions. However, some cationic fabric softening actives perform in some ways less well than others.

Accordingly, there remains a need in the art for a cationic charge boosting system suitable for use in the wide array of fabric softener formulations and embodiments which provide an increased or "boosted" fabric softening capacity. In addition, fabric softener compositions which comprise said fabric softener actives having suitable properties other than sufficient cationic charge density, need a means to boost the overall charge density thereby providing to the consumer a better fabric care benefit.

SUMMARY OF THE INVENTION

It has now been surprisingly discovered that the addition of a cationic charge boosting system will sufficiently increase the performance of cationic fabric softener actives having diminished or insufficient charge density, to a level which allows the low charge density active to be used in fabric softening formulations. Surprisingly, the most effective charge booster systems of the present invention are systems which comprise an admixture of two or more di-amino compounds wherein at least one of said compounds is a di-quaternary ammonium compound.

It has also been surprisingly discovered that the cationic charge boosting systems which are admixtures of di-amino compounds have increased formulatability with other adjunct ingredients, thereby enabling the formulator to provide a wider array of targeted fabric enhancement benefits. In some embodiments, fabric softener actives not possessing sufficient cationic charge characteristics are now suitable for inclusion in fabric softener compositions when formulated together with a charge boosting system according to the present invention.

The cationic charge enhancing agents of the present invention have the effect of increasing the net cationic charge concentration independent of the intrinsic properties of the softener active. Therefore, the formulator may combine fabric softener actives having low cationic charge capacity, but which have other desirable properties inter alia good dispensability, low melting point, with cationic charge booster systems thereby obtaining a composition which overcomes the lack of cationic charge density of the fabric softener active.

The first aspect of the present invention relates to fabric softener compositions comprising:

a) from about 2%, preferably from about 5% to about 60%, more preferably to about 40% by weight, of a fabric softening active;

b) from about 0.2%, preferably from about 5% to about 10%, preferably to about 7% by weight, of a cationic charge boosting system; and c) the balance carriers and other adjunct ingredients.

The charge booster systems of the present invention are admixtures of diamines, quaternary ammonium compounds, and di-quaternary ammonium compounds formed from process comprising the steps of:

i) reacting one equivalent of a diamine having the formula:

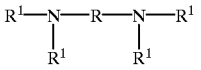

wherein R is $C_2$–$C_{12}$ alkylene; each $R^1$ is independently hydrogen, $C_1$–$C_4$ alkyl, a unit having the formula:

$$—R^2—Z$$

wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, —OH, —$NH_2$, and mixtures thereof; with from about 0.1 equivalents to about 8 equivalents of an acylating agent to form an acylated di-amino admixture; and ii) reacting said acylated di-amino admixture with from 0.1 equivalents to 2 equivalents of a quaternizing agent to form a cationic charge booster system.

The present invention further relates to methods for boosting the softening activity of fabric softening actives by admixing a fabric softener with a cationic charge boosting system according to the present invention.

These and other objects, features and advantages will become apparent to those of ordinary skill in the art from a reading of the following detailed description and the appended claims. All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

The present invention relates to improving the softening capacity of fabric softener actives, preferably Diester and Diamide Quaternary Ammonium (DEQA) fabric softening actives. Without wishing to be limited by theory it has been surprisingly discovered that the performance of fabric softener actives can be further enhanced by combining said actives with a cationic charge booster system. The effect is to increase the overall charge density of the total softener composition.

The increased softness benefit is also augmented by the presence of other adjunct ingredients depending upon the type of embodiment, inter alia, dispersed phase fabric softeners or isotropic softener compositions. Adjunct ingredients which provided for increased performance are, inter alia, polyoxyalkylene akyl amide surface active agents, which for example, when added to clear, translucent liquids, lowers the level of principal solvent necessary to maintain an isotropic formulation.

Because of the variety of formulation types, the cationic charge booster systems of the present invention will necessarily comprise a wide range of di-amino compounds depending upon the desired properties of the final formulation. Isotropic liquids may be formulated to be colorless solutions or the formulator may tint or color the compositions to satisfy the aesthetic decor indicated by the consumer. Typically the level of principal solvent present in the compositions of the present invention is typically less than about 15%, preferably less than about 12%, more preferably less than about 9%, most preferably less than about 5% by weight. Although compositions comprising nil principal solvent are achievable by the present invention, the presence of one or more principal solvents at a level of from about 0.5% to about 10% may be desirable by the formulator. For example, in order to formulate one or more ingredients, or to provide a homogeneous admixture of ingredients (e.g., colorants), one or more principal solvents may be used as a co-solvent or carrier during processing. Therefore, the presence of a principal solvent may be due to the fact that said principal solvent was carried into the composition as part of a feedstock composition. In addition, some level of principal solvent may be necessary to maintain product clarity at low temperatures.

The most common formulation is the dispersed phase fabric softener compositions. The formulator by varying the reaction conditions which produce the herein described cationic charge booster systems may afford a wide range of fabric softener compositions which when combined with other adjunct ingredients provide a variety of fabric enhancement benefits. For example, although a single cationic charge boosting compound may not be compatible with one or more adjunct ingredients, it has been surprisingly found that the admixtures described herein below over come this lack of formulatability while providing enhanced charge boosting benefits.

The following is a description of the essential components of the present invention.

Quaternary Ammonium Fabric Softening Active Compounds (DEQA)

The amount of fabric softening active present in the compositions of the present invention is at least about 2%, preferably from about 2%, more preferably from about 5% to about 60%, more preferably to about 40% by weight, of the composition. The preferred fabric softening actives according to the present invention have the formula:

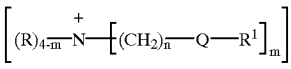

wherein each R is independently $C_1$–$C_6$ alkyl, $C_1$–$C_6$ hydroxyalkyl, benzyl, and mixtures thereof; $R^1$ is $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from units having the formula:

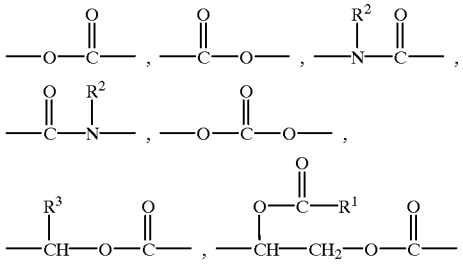

wherein $R^2$ is hydrogen, $C_1$–$C_4$ alkyl, and mixtures thereof; $R^3$ is hydrogen, $C_1$–$C_4$ alkyl, and mixtures thereof; preferably Q is a unit having the formula:

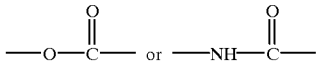

X is a softener compatible anion, preferably the anion of a strong acid, for example, chloride, bromide, methylsulfate, ethylsulfate, sulfate, nitrate and mixtures thereof, more preferably chloride and methyl sulfate. The anion can also, but less preferably, carry a double charge, in which case $X^{(-)}$ represents half a group. The index m has a value of from 1 to 3; the index n has a value of from 1 to 4, preferably 2 or 3, more preferably 2.

More preferred softener actives according to the present invention have the formula:

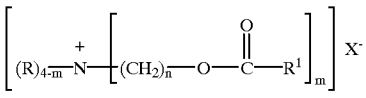

wherein the unit having the formula:

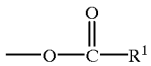

is a fatty acyl moiety. Suitable fatty acyl moieties for use in the softener actives of the present invention are derived from sources of triglycerides selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof.

The $R^1$ comprising acyl units are typically mixtures of linear and branched chains of both saturated and unsaturated aliphatic fatty acids, an example of which (canola oil), is described in Table I herein below.

TABLE I

| Fatty acyl unit | % |
|---|---|
| C14 | 0.1 |
| C16 | 5.4 |
| C16:1 | 0.4 |
| C18 | 5.7 |
| C18:1 | 67.0 |
| C18:2 | 13.5 |
| C18:3 | 2.7 |
| C20 | 0.5 |
| C20:1 | 4.6 |

The formulator, depending upon the desired physical and performance properties of the final fabric softener active, can choose any of the above mentioned sources of fatty acyl moieties, or alternatively, the formulator can mix sources of triglyceride to form a "customized blend". However, those skilled in the art of fats and oils recognize that the fatty acyl composition may vary, as in the case of vegetable oil, from crop to crop, or from variety of vegetable oil source to variety of vegetable oil source. DEQA's which are prepared using fatty acids derived from natural sources are preferred for embodiments of the isotropic.

A preferred embodiment of the present invention provides softener actives comprising $R^1$ units which have at least about 3%, preferably at least about 5%, more preferably at least about 10%, most preferably at least about 15% $C_{11}$–$C_{22}$ alkenyl, including polyalkenyl (polyunsaturated) units inter alia oleic, linoleic, linolenic.

For the purposes of the present invention the term "mixed chain fatty acyl units" is defined as "a mixture of fatty acyl units comprising alkyl and alkenyl chains having from 10 carbons to 22 carbon atoms including the carbonyl carbon atom, and in the case of alkenyl chains, from one to three double bonds, preferably all double bonds in the cis configuration". With regard to the $R^1$ units of the present invention, it is preferred that at least a substantial percentage of the fatty acyl groups are unsaturated, e.g., from about 25%, preferably from about 50% to about 70%, preferably to about 65%. The total level of fabric softening active containing polyunsaturated fatty acyl groups can be from about 3%, preferably from about 5%, more preferably from about 10% to about 30%, preferably to about 25%, more preferably to about 18%. As stated herein above cis and trans isomers can be used, preferably with a cis/trans ratio is of from 1:1, preferably at least 3:1, and more preferably from about 4:1 to about 50:1, more preferably about 20:1, however, the minimum being 1:1.

The $R^1$ units suitable for use in the present invention can be further characterized by the Iodine Value (IV) of the parent fatty acid, said IV is preferably from about 20, more preferably from about 50, most preferably from about 70, to a value of about 140, preferably to about 130, more preferably to about 115. However, formulators, depending upon which embodiment of the present invention they choose to execute, may wish to add an amount of fatty acyl units which have Iodine Values outside the range listed herein above. For example, "hardened stock" (IV less than or equal to about 10) may be combined with the source of fatty acid admixture to adjust the properties of the final softener active. A further preferred embodiment of the present invention comprises DEQA's wherein the average Iodine Value for $R^1$ is approximately 45.

Amines which are used to prepare the preferred fabric softening actives of the present invention have the formula:

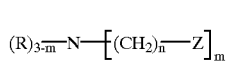

wherein R is the same as defined herein above; each Z is independently selected from the group consisting of —OH, —$CHR^3OH$, —$CH(OH)CH_2OH$, —$NH_2$, and mixtures thereof; preferably —OH, —$NH_2$, and mixtures thereof; $R^3$ is $C_1$–$C_4$ alkyl, preferably methyl; the indices m and n are the same as defined hereinabove.

Non-limiting examples of preferred amines which are used to form the DEQA fabric softening actives according to the present invention include methyl bis(2-hydroxyethyl) amine, methyl bis(2-hydroxypropyl)amine, methyl (3-aminopropyl) (2-hydroxyethyl)amine, methyl bis(2-aminoethyl)amine, triethanol amine, and bis(2-aminoethyl) ethanolamine.

For the purposes of the present invention, R moieties which are introduced during the quaternization step are preferably methyl. In the case of amines having the formula:

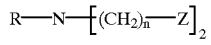

R is preferably the same moiety (i.e. methyl) which is introduced during the quaternization step.

The following are examples of preferred softener actives according to the present invention.

N,N-di(tallowyl-oxy-ethyl)-N,N-dimethyl ammonium chloride;

N,N-di(canolyl-oxy-ethyl)-N,N-dimethyl ammonium chloride;

N,N-di(tallowyl-oxy-ethyl)-N-methyl, N-(2-hydroxyethyl) ammonium chloride;

N,N-di(canolyl-oxy-ethyl)-N-methyl, N-(2-hydroxyethyl) ammonium chloride;

N,N-di(2-tallowyloxy-2-oxo-ethyl)-N,N-dimethyl ammonium chloride;

N,N-di(2-canolyloxy-2-oxo-ethyl)-N,N-dimethyl ammonium chloride

N,N-di(2-tallowyloxyethylcarbonyloxyethyl)-N,N-dimethyl ammonium chloride;

N,N-di(2-canolyloxyethylcarbonyloxyethyl)-N,N-dimethyl ammonium chloride;

N-(2-tallowoyloxy-2-ethyl)-N-(2-tallowyloxy-2-oxo-ethyl)-N,N-dimethyl ammonium chloride;

N-(2-canolyloxy-2-ethyl)-N-(2-canolyloxy-2-oxo-ethyl)-N,N-dimethyl ammonium chloride;

N,N,N-tri(tallowyl-oxy-ethyl)-N-methyl ammonium chloride;

N,N,N-tricanolyl-oxy-ethyl)-N-methyl ammonium chloride;

N-(2-tallowyloxy-2-oxoethyl)-N-(tallowyl)-N,N-dimethyl ammonium chloride;

N-(2-canolyloxy-2-oxoethyl)-N-(canolyl)-N,N-dimethyl ammonium chloride;

1,2-ditallowyloxy-3-N,N,N-trimethylammoniopropane chloride; and 1,2-dicanolyloxy-3-N,N,N-trimethylammoniopropane chloride;

and mixtures of the above actives. The anion methosulfate can be suitably substituted for chloride in the above examples.

Particularly preferred is N,N-di(tallowoyl-oxy-ethyl)-N,N-dimethyl ammonium chloride N,N-di(tallowyl-oxy-ethyl)-N-methyl, N-(2-hydroxyethyl) ammonium methosulfate, where the tallow chains are at least partially unsaturated and N,N-di(canoloyl-oxy-ethyl)-N,N-dimethyl ammonium chloride and N,N-di(canolyl-oxy-ethyl)-N-methyl, N-(2-hydroxyethyl) ammonium methosulfate.

Additional fabric softening agents useful herein are described in U.S. Pat. No. 5,643,865 Mermelstein et al., issued Jul. 1, 1997; U.S. Pat. No. 5,622,925 de Buzzaccarini et al., issued Apr. 22, 1997; U.S. Pat. No. 5,545,350 Baker et al., issued Aug. 13, 1996; U.S. Pat. No. 5,474,690 Wahl et al., issued Dec. 12, 1995; U.S. Pat. No. 5,417,868 Turner et al., issued Jan. 27, 1994; U.S. Pat. No. 4,661,269 Trinh et al., issued Apr. 28, 1987; U.S. Pat. No. 4,439,335 Burns, issued Mar. 27, 1984; U.S. Pat. No. 4,401,578 Verbruggen, issued Aug. 30, 1983; U.S. Pat. No. 4,308,151 Cambre, issued Dec. 29, 1981; U.S. Pat. No. 4,237,016 Rudkin et al., issued Oct. 27, 1978; U.S. Pat. No. 4,233,164 Davis, issued Nov. 11, 1980; U.S. Pat. No. 4,045,361 Watt et al., issued Aug. 30, 1977; U.S. Pat. No. 3,974,076 Wiersema et al., issued Aug. 10, 1976; U.S. Pat. No. 3,886,075 Bernadino, issued May 6, 1975; U.S. Pat. No. 3,861,870 Edwards et al., issued Jan. 21, 1975; and European Patent Application publication No. 472,178, by Yamamura et al., all of said documents being incorporated herein by reference.

Cationic Charge Booster System

The compositions of the present invention comprise from about 0.2%, preferably from about 5% to about 10%, preferably to about 7% by weight, of a charge booster system.

The cationic charge booster systems of the present invention are an admixture of two or more di-amino compounds wherein at least one of said di-amino compounds is a di-quaternary ammonium compound.

Preferably said charge booster system is the admixture of di-amino compounds which results from a process comprising the steps of:

i) reacting one equivalent of a diamine having the formula:

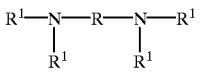

wherein R is $C_2$–$C_{12}$ alkylene; each $R^1$ is independently hydrogen, $C_1$–$C_4$ alkyl, a unit having the formula:

$$—R^2—Z$$

wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, —OH, —$NH_2$, and mixtures thereof; with from about 0.1 equivalent to about 8 equivalents of an acylating unit to form an acylated di-amino admixture; and ii) reacting said acylated di-amino admixture with from 0.1 equivalents to 2 equivalents of a quaternizing agent to form said cationic charge booster system.

Step (i) of the present cationic charge booster producing process, is an acylation step. The acylation of the amino compound may be conducted under any conditions which allow the formulator to prepare the desired final cationic admixture or an admixture which has the desired final charge boosting properties.

Step (ii) of the present cationic charge booster producing process, is the quaternization step. The formulator may use any quaternizing agent which provides an admixture having the desired charge boosting properties. The choice of from 0.1 equivalents to 2 equivalents of quaternizing agent will provide the formulator with a wide array of cationically charged di-amines in the final admixture.

Non-limiting examples of acylating agents suitable for use in the present invention include, acylating agents selected from the group consisting of:

a) acyl halides having the formula:

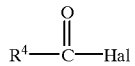

b) an ester having the formula:

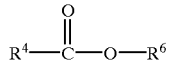

c) anhydrides having the formula:

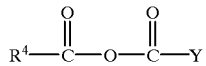

d) carboxylic/carbonic anhydrides having the formula:

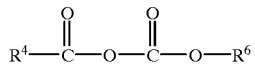

e) acyl azides having the formula:

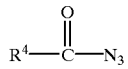

f) and mixtures thereof;

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; Hal is a halogen selected from chlorine, bromine, or iodine; $R^6$ is $R^4$, $C_1$–$C_5$ linear or branched alkyl; Y is $R^4$, —$CF_3$, —$CCl_3$, and mixtures thereof.

An example of a preferred process comprises the reaction of an amine having the formula:

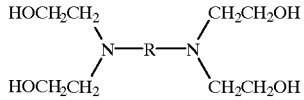

wherein R is hexamethylene, with about two equivalents of an acylating agent to form a partially acylated diamine admixture, followed by reaction of said admixture with from about 1.25 to about 1.75 equivalents of a quaternizing unit, preferably dimethyl sulfate.

Non-limiting examples of preferred di-amines which comprise the cationic charge booster systems of the present invention include:

i) one or more diamines having the formula:

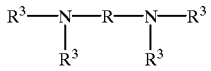

ii) one or more quaternary ammonium compounds having the formula:

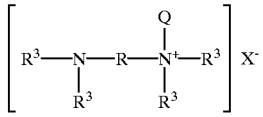

iii) one or more di-quaternary ammonium compounds having the formula:

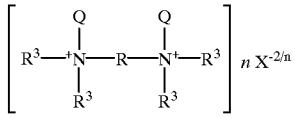

wherein R is $C_2$–$C_{12}$ alkylene, preferably $C_2$–$C_8$ alkylene, more preferably hexamethylene; each $R^3$ is independently $R^1$, an acyl comprising unit having the formula:

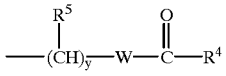

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)_zWC(O)R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7.

Suitable sources of acyl units which comprise the cationic charge booster systems include acyl units which are derived from sources of triglycerides selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof.

Preferably at least two $R^3$ units are units having the formula;

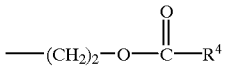

wherein $R^4$ comprises an acyl which is derived from a triglyceride source selected from the group consisting of hard tallow, soft tallow, canola, oleoyl, and mixtures thereof; Q is methyl; X is a water soluble cation; the index n is 2.

The following is an example of a di-amino admixture suitable for use as a cationic charge boosting system according to the present invention.

i) diamines having the formula:

$(HOCH_2CH_2)_2N(CH_2)_6N(CH_2CH_2OH)_2$ $(HOCH_2CH_2)_2N(CH_2)_6N(CH_2CH_2OH)(CH_2CH_2OCR^4)$ $(R^4COCH_2CH_2)(HOCH_2CH_2)N(CH_2)_6N(CH_2CH_2OH)(CH_2CH_2OCR^4)$ $(R^4COCH_2CH_2)(HOCH_2CH_2)N(CH_2)_6N(CH_2CH_2OCR^4)_2$ $(R^4COCH_2CH_2)(HOCH_2CH_2)N(CH_2)_6N(CH_2CH_2OH)_2$ $(R^4COCH_2CH_2)_2N(CH_2)_6N(CH_2CH_2OCR^4)_2$ ii) quaternary ammonium compounds having the formula:

$(HOCH_2CH_2)_2N^+(CH_3)(CH_2)_6N(CH_2CH_2OH)_2$ $(HOCH_2CH_2)_2N^+(CH_3)(CH_2)_6N(CH_2CH_2OH)(CH_2CH_2OCR^4)$ $(R^4COCH_2CH_2)(HOCH_2CH_2)N^+(CH_3)(CH_2)_6N(CH_2CH_2OH)_2$ $(R^4COCH_2CH_2)(HOCH_2CH_2)N^+(CH_3)(CH_2)_6N(CH_2CH_2OH)(CH_2CH_2OCR^4)$ $(HOCH_2CH_2)_2N^+(CH_3)(CH_2)_6N(CH_2CH_2OCR^4)_2$ $(R^4COCH_2CH_2)_2N^+(CH_3)(CH_2)_6N(CH_2CH_2OH)_2$ $(R^4COCH_2CH_2)_2N^+(CH_3)(CH_2)_6N(CH_2CH_2OH)(CH_2CH_2OCR^4)$ $(R^4COCH_2CH_2)(HOCH_2CH_2)N^+(CH_3)(CH_2)_6N(CH_2CH_2OCR^4)_2$ $(R^4COCH_2CH_2)_2N^+(CH_3)(CH_2)_6N(CH_2CH_2OCR^4)_2$ iii) di-quaternary ammonium compounds having the formula:

$(HOCH_2CH_2)_2N^+(CH_3)(CH_2)_6N^+(CH_3)(CH_2CH_2OH)_2$ $(R^4COCH_2CH_2)(HOCH_2CH^2)N^+(CH_3)(CH_2)_6N^+(CH_3)(CH_2CH_2OH)_2$ $(R^4COCH_2CH_2)(HOCH_2CH_2)N^+(CH_3)(CH_2)_6N^+(CH_3)(CH_2CH_2OH)(CH_2CH_2OCR^4)$ $(R^4COCH_2CH_2)_2N^+(CH_3)(CH_2)_6N^+(CH_3)(CH_2CH_2OH)(CH_2CH_2OCR^4)$ $(R^4COCH_2CH_2)_2N^+(CH_3)(CH_2)_6N^+(CH_3)(CH_2CH_2OCR^4)_2$ wherein the acyl unit —$C(O)R^4$ is derived from canola.

Fabric Care Compositions

The present invention relates to fabric care compositions which comprise:

a) from about 2%, preferably from about 5% to about 60%, more preferably to about 40% by weight, of a fabric softening active;

b) from about 0.2%, preferably from about 5% to about 10%, preferably to about 7% by weight, of a cationic charge boosting system c) optionally less than about 15% by weight, of a principal solvent, preferably said principal solvent has a ClogP of from about 0.15 to about 1;

d) optionally from about 0.001% to about 90% by weight, of one or more dye fixing agents;

e) optionally from about 0.01% to about 50% by weight, of one or more cellulose reactive dye fixing agents;

f) optionally from about 0.01% to about 15% by weight, of a chlorine scavenger;

g) optionally about 0.005% to about 1% by weight, of one or more crystal growth inhibitors;

h) optionally from about 1% to about 12% by weight, of one or more liquid carriers;

i) optionally from about 0.001% to about 1% by weight, of an enzyme;

j) optionally from about 0.01% to about 8% by weight, of a polyolefin emulsion or suspension;

k) optionally from about 0.01% to about 0.2% by weight, a stabilizing system, said stabilizing system comprising:

i) from about 0.25%, preferably from about 0.5%, more preferably from about 1%, most preferably from about 1.5% to about 13.5%, preferably to about 10%, more preferably to about 7%, most preferably to about 5% by weight of an organic solvent; and ii) from about 0.25%, preferably from about 0.5%, more preferably from about 1%, most preferably from about 2.5% to about 20%, preferably to about 15%, more preferably to about 12%, still more preferably to about 10%, most preferably to about 8% by weight, of a bilayer modifier;

l) from about 0.01% by weight, of one or more linear or cyclic polyamines which provide bleach protection;

m) from about 20 to about 10,000 parts per million (ppm) by weight, of a electrolyte;

o) from about 0.001%, preferably from about 0.01% to about 10%, preferably to about 5%, more preferably to about 3% by weight, of a chelant; and p) the balance carrier and adjunct ingredients.

Adjunct Ingredients

The following are non-limiting examples of adjunct ingredients which can be suitably used in the compositions of the present invention.

Chelants

The compositions formed via the present invention may include one or more chelating agents such as copper and/or nickel chelating agents ("chelators"), for example, diethylenetriaminepentaacetic acid (DTPA) or ethylenediamine-N, N'-disuccinnic acid (EDDS) which can be added during the formation of the fabric softening active or the fabric softening composition. The chelating agent may be present in the composition in the range of from about 0.001%, preferably from about 0.01% to about 10%, preferably to about 5%, more preferably to about 3% by weight, of the composition.

Such water-soluble chelating agents can be selected from the group consisting of amino carboxylates, amino phosphonates, polyfunctionally-substituted aromatic chelating agents and mixtures thereof, all as hereinafter defined and all preferably in their acidic form. Amino carboxylates useful as chelating agents herein include ethylenediaminetetraacetic acid (EDTA), N-hydroxyethylethylenediaminetriacetates, nitrilotriacetates (NTA), ethylenediamine tetraproprionates, ethylenediamine-N,N'-diglutamates, 2-hyroxypropylenediamine-N,N'-disuccinates, triethylenetetraaminehexacetates, diethylenetriaminepentaacetates (DTPA) and ethanoldiglycines, including their water-soluble salts such as the alkali metal, ammonium, and substituted ammonium salts thereof and mixtures thereof.

Amino phosphonates are also suitable for use as chelating agents in the compositions of the invention when at least low levels of total phosphorus are permitted in rinse-added fabric softener compositions, and include ethylenediaminetetrakis (methylenephosphonates), diethylenetriamine-N,N,N',N", N"-pentakis(methane phosphonate) (DTMP) and 1-hydroxyethane-1,1-diphosphonate (HEDP). Preferably, these amino phosphonates to not contain alkyl or alkenyl groups with more than about 6 carbon atoms.

As can be seen from the foregoing, a wide variety of chelators may be added to the compositions. Indeed, simple polycarboxylates such as citrate, oxydisuccinate, and the like, may also be used, although such chelators are not as effective as the amino carboxylates and phosphonates, on a weight basis. Accordingly, usage levels may be adjusted to take into account differing degrees of chelating effectiveness. The chelators herein will preferably have a stability constant (of the fully ionized chelator) for copper ions of at least about 5, preferably at least about 7. Typically, the chelators will comprise from about 0.5% to about 10%, more preferably from about 0.75% to about 5%, by weight of the compositions herein.

For preferred chelants for use in obtaining enhanced color fidelity in the compositions of the present invention see U.S. Pat. No. 5,686,376 Rusche et al., issued Nov. 11, 1997 included herein by reference in its entirety.

Polyamines

A preferred composition of the present invention comprises from about 0.1%, preferably from about 5%, more preferably from about 10% to about 80%, preferably to about 50%, more preferably to about 25% by weight, of a polyamine having the formula:

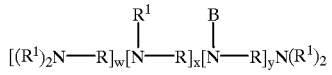

wherein R, $R^1$ and B are suitably described in U.S. Pat. No. 5,565,145 Watson et al., issued Oct. 15, 1996 incorporated herein by reference, and w, x, and y have values which provide for a backbone prior to substitution of preferably at least about 1200 daltons, more preferably 1800 daltons.

$R^1$ units are preferably alkyleneoxy units having the formula:

$$-(CH_2CHR'O)_m(CH_2CH_2O)_nH$$

wherein $R^1$ is methyl or ethyl, m and n are preferably from about 0 to about 50, provided the average value of alkoxylation provided by m+n is at least about 0.5.

A further description of polyamine dispersants suitable for use in the present invention is found in U.S. Pat. No. 4,891,160 Vander Meer, issued Jan. 2, 1990; U.S. Pat. No. 4,597,898, Vander Meer, issued Jul. 1, 1986; European Patent Application 111,965, Oh and Gosselink, published Jun. 27, 1984; European Patent Application 111,984, Gosselink, published Jun. 27, 1984; European Patent Application 112,592, Gosselink, published Jul. 4, 1984; U.S. Pat. No. 4,548,744, Connor, issued Oct. 22, 1985; and U.S. Pat. No. 5,565,145 Watson et al., issued Oct. 15, 1996; all of which are included herein by reference. However, any suitable clay/soil dispersent or anti-redepostion agent can be used in the laundry compositions of the present invention.

Electrolyte

The fabric softening embodiments of the compositions of the present invention, especially clear, isotropic liquid fabric softening compositions, may also optionally, but preferably comprise, one or more electrolytes for control of phase stability, viscosity, and/or clarity. For example, the presence of certain electrolytes inter alia calcium chloride, magnesium chloride may be key to insuring initial product clarity and low viscosity, or may affect the dilution viscosity of liquid embodiments, especially isotropic liquid embodiments. Not wishing to be limited by theory, but only wishing to provide an example of a circumstance wherein the formulator must insure proper dilution viscosity, includes the following example. Isotropic or non-isotropic liquid fabric softener compositions can be introduced into the rinse phase of laundry operations via an article of manufacture designed to dispense a measured amount of said composition. Typically the article of manufacture is a dispenser which delivers the softener active only during the rinse cycle. These dispensers are typically designed to allow an amount of water equal to the volume of softener composition to enter into the dispenser to insure complete delivery of the softener composition. An electrolyte may be added to the compositions of the present invention to insure phase stability and prevent the diluted softener composition from "gelling out" or from undergoing an undesirable or unacceptable viscosity increase. Prevention of gelling or formation of a "swelled", high viscosity solution insures thorough delivery of the softener composition.

However, those skilled in the art of fabric softener compositions will recognize that the level of electrolyte is also influenced by other factors inter alia the type of fabric softener active, the amount of principal solvent, and the level and type of nonionic surfactant. For example, triethanol amine derived ester quaternary amines suitable for use as softener actives according to the present invention are typically manufactured in such a way as to yield a distribution of mono-, di-, and tri- esterified quaternary ammonium compounds and amine precursors. Therefore, as in this example, the variability in the distribution of mono-, di-, and tri- esters and amines may predicate a different level of electrolyte. Therefore, the formulator must consider all of the ingredients, namely, softener active, nonionic surfactant, and in the case of isotropic liquids, the principal solvent type and level, as well as level and identity of adjunct ingredients before selecting the type and/or level of electrolyte.

A wide variety of ionizable salts can be used. Examples of suitable salts are the halides of the Group IA and IIA metals of the Periodic Table of the elements, e.g., calcium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 5,000 ppm, of the composition.

Alkylene polyammonium salts can be incorporated into the composition to give viscosity control in addition to or in place of the water-soluble, ionizable salts above, In addition, these agents can act as scavengers, forming ion pairs with anionic detergent carried over from the main wash, in the rinse, and on the fabrics, and can improve softness performance. These agents can stabilized the viscosity over a broader range of temperature, especially at low temperatures, compared to the inorganic electrolytes. Specific examples of alkylene polyammonium salts include L-lysine, monohydrochloride and 1,5-diammonium 2-methyl pentane dihydrochloride.

Soil Release Agents

Particular to the embodiments of the rinse-added fabric softeners according to the present invention, certain soil release agents provide not only the below described soil release properties but are added for their suitability in maintaining proper viscosity, especially in the dispersed phase, non-isotropic compositions.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of the rinsing cycle and, thus, serve as an anchor for the hydrophilic segments. This can enable stains occurring subsequent to treatment with the soil release agent to be more easily cleaned in later washing procedures.

If utilized, soil release agents will generally comprise from about 0.01% to about 10.0%, by weight, of the fabric care compositions herein, typically from about 0.1% to about 5%, preferably from about 0.2% to about 3.0%.

The following, all included herein by reference, describe soil release polymers suitable for us in the present invention. U.S. Pat. No. 5,728,671 Rohrbaugh et al., issued Mar. 17, 1998; U.S. Pat. No. 5,691,298 Gosselink et al., issued Nov. 25, 1997; U.S. Pat. No. 5,599,782 Pan et al., issued Feb. 4, 1997; U.S. Pat. No. 5,415,807 Gosselink et al., issued May 16, 1995; U.S. Pat. No. 5,182,043 Morrall et al., issued Jan. 26, 1993; U.S. Pat. No. 4,956,447 Gosselink et al., issued Sep. 11, 1990; U.S. Pat. No. 4,976,879 Maldonado et al., issued Dec. 11, 1990; U.S. Pat. No. 4,968,451 Scheibel et al., issued Nov. 6, 1990; U.S. Pat. No. 4,925,577 Borcher, Sr. et al., issued May 15, 1990; U.S. Pat. No. 4,861,512 Gosselink, issued Aug. 29, 1989; U.S. Pat. No. 4,877,896 Maldonado et al., issued Oct. 31, 1989; U.S. Pat. No. 4,721,580 Gosselink issued Jan. 26, 1988; U.S. Pat. No. 4,702,857 Gosselink, issued Oct. 27, 1987; U.S. Pat. No. 4,711,730 Gosselink et al., issued Dec. 8, 1987; U.S. Pat. No. 4,000,093 Nicol et al., issued Dec. 28, 1976; U.S. Pat. No. 3,959,230 Hayes, issued May 25, 1976; U.S. Pat. No. 3,893,929 Basadur, issued Jul. 8, 1975; and European Patent Application 0 219 048, published Apr. 22, 1987 by Kud et al.

Further suitable soil release agents are described in U.S. Pat. No. 4,201,824 Voilland et al.; U.S. Pat. No. 4,240,918 Lagasse et al.; U.S. Pat. No. 4,525,524 Tung et al.; U.S. Pat. No. 4,579,681 Ruppert et al.; U.S. Pat. No. 4,220,918; U.S. Pat. No. 4,787,989; EP 279,134 A, 1988 to Rhone-Poulenc Chemie; EP 457,205 A to BASF (1991); and DE 2,335,044 to Unilever N.V., 1974; all incorporated herein by reference.

Non-limiting examples of other optional ingredients useful in compositions of the present invention include, but are not limited to, dye transfer inhibiting agents, scum dispersants, suds suppressors, optical brighteners or other brightening or whitening agents, dye fixing agents, light fading protection agents, oxygen bleach protection agents, fabric softening clay, anti-static agents, other active ingredients, carriers, hydrotropes, processing aids, dyes or pigments, bactericides, colorants, perfumes, preservatives, opacifiers, anti-shrinkage agents, anti-wrinkle agents, fabric crisping agents, spotting agents, germicides, fungicides, anti-corrosion agents, and the like.

Isotropic Liquids

One type of preferred embodiment of the present invention is the clear, translucent, isotropic liquid composition. In order to form said compositions a stabilizing system is necessary, said stabilizing system comprising:

a) from about 0.25%, preferably from about 0.5%, more preferably from about 1%, most preferably from about 1–5% to about 13.5%, preferably to about 10%, more preferably to about 7%, most preferably to about 5% by weight of an organic solvent; and b) from about 0.25%, preferably from about 0.5%, more preferably from about 1%, most preferably from about 2.5% to about 20%, preferably to about 15%, more preferably to about 12%, still more preferably to about 10%, most preferably to about 8% by weight, of a bilayer modifier.

The following are non-limiting examples of the components which comprise a stabilizing system for clear, translucent, isotropic liquid fabric softening compositions.

Organic/Principal Solvent

A wide range of organic solvents are effective including those heretofore characterized as "principal solvents" which fall within the broadest Clog P limits used to define principal solvents. Modifications of the ClogP ranges can be achieved by adding electrolyte and/or phase stabilizers as taught in copending U.S. patent application Ser. No. 09/309,128, filed May 10, 1999 by Frankenbach, et al.

Principal solvents are selected to minimize solvent odor impact in the composition and to provide a low viscosity to the final composition. For example, isopropyl alcohol is flammable and has a strong odor. n-Propyl alcohol is more effective, but also has a distinct odor. Several butyl alcohols also have odors but can be used for effective clarity/stability, especially when used as part of a principal solvent system to minimize their odor. The alcohols are also selected for optimum low temperature stability, that is they are able to form compositions that are liquid with acceptable low viscosities and translucent, preferably clear, down to about 50° F. (about 10° C.), more preferably down to about 40° F. (about 4.4° C.) and are able to recover after storage down to about 20° F. (about 6.7° C.).

Other suitable solvents can be selected based upon their octanol/water partition coefficient (P). Octanol/water partition coefficient of a solvent is the ratio between its equilibrium concentration in octanol and in water. The partition coefficients of the solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention. Other methods that can be used to compute ClogP include, e.g., Crippen's fragmentation method as disclosed in J. Chem. Inf. Comput. Sci., 27, 21 (1987); Viswanadhan's fragmentation method as disclose in J. Chem. Inf. Comput. Sci., 29, 163 (1989); and Broto's method as disclosed in Eur. J. Med. Chem.—Chim. Theor., 19, 71 (1984).

The principal solvents herein are selected from those having a ClogP of from −2.0 to 2.6, preferably from −1.7 to 1.6, and more preferably from −1.0 to 1.0., The most preferred solvents can be identified by the appearance of the diluted fabric treatment compositions. These diluted compositions comprise vesicular dispersions of fabric softener which contain on average more uni-lamellar vesicles than conventional fabric softener compositions, which contain predominantly multilamellar vesicles. The larger the proportion of uni-lamellar vs. multilamellar vesicles, the better the compositions seem to perform. These compositions provide surprisingly good fabric softening as compared to similar compositions prepared in the conventional way with the same fabric softener active.

Operable solvents have been disclosed, listed under various listings, e.g., aliphatic and/or alicyclic diols with a given number of carbon atoms; monols; derivatives of glycerine; alkoxylates of diols; and mixtures of all of the above can be found in U.S. Pat. No. 5,759,990 Wahl et al., issued Jun. 2, 1998; U.S. Pat. No. 5,747,443 Wahl et al., issued May 5, 1998 and PCT application WO 97/03169 published on Jan. 30, 1997, said patents and application being incorporated herein by reference.

Principal solvents preferred for improved clarity at 50° F. are 2-ethyl-1,3-hexanediol, 1,2-hexanediol; 1,2-pentanediol; hexylene glycol; 1,2-butanediol; 1,4-cyclohexanediol; pinacol; 1,5-hexanediol; 1,6-hexanediol; and/or 2,4-dimethyl-2,4-pentanediol.

Bilayer Modifiers

Bilayer modifiers are compounds which allow the formation of stable formulations at lower and substantially reduced solvent levels even to the point of, surprisingly, eliminating solvent in some compositions.

An advantage of the bilayer modifiers disclosed herein is the lower levels of principal solvents and/or a wider range of principal solvents can be used to provide clarity. For example, without a bilayer modifier, the ClogP of the principal solvent system as disclosed herein would typically be limited to a range of from about 0.15 to about 0.64 as disclosed in U.S. Pat. No. 5,747,443 Wahl et al., issued May 5, 1998. It is known that higher ClogP compounds, up to about 1 can be used when combined with other solvents as disclosed in copending provisional application Serial No. 60/047,058, filed May 19, 1997 and refiled PCT/US98/10167 on May 18, 1998, in the names of H. B. Tordil, E. H. Wahl, T. Trinh, M. Okamoto, and D. L. Duval, or with nonionic surfactants, and especially with the phase stabilizers disclosed herein as previously disclosed in Docket No. 7039P, filed Mar. 2, 1998, Provisional Application S.N. 60/076,564, and refiled as, the inventors being D. L. DuVal, G. M. Frankenbach, E. H. Wahl, T. Trinh, H. J. M. Demeyere, J. H. Shaw and M. Nogami. Title: Concentrated, Stable, Translucent or Clear Fabric Softening Compositions, both of said applications being incorporated herein by reference. With the bilayer modifier present, the level of principal solvent can be less and/or the ClogP range that is usable is broadened to include from about −2.0 to about 2.6, more preferably from about −1.7 to about 1.6, and even more preferably from about −1.0 to about 1.0.

Fabric softening actives, especially those actives or compositions comprising multiple hydrophobes tend to form bilayers. When these bilayers and the water between the bilayers are sufficiently flexible, the composition can become a single-phase isotropic system comprising a bicontinuous bilayer or sponge phase.

There are many ways to improve flexibility such that single-phase isotropic bicontinuous systems with improved stability are achieved. Using fabric softening actives with low phase transition temperatures enhances flexibility of the bilayer since the actives are fluid. The phase transition temperature can be lowered by several means, for instance by incorporating branching and/or unsaturation in the hydrophobe of fabric softener actives and employing mixtures of fabric softener actives. Using principal solvents, particularly those within the most preferred Clog P ranges enhances the flexibility of both the water and the bilayer because these principal solvents, especially in the more preferred ranges, have the ability to migrate between the water where they can break up the water hydrogen bond structure and the bilayer interface where they can promote net zero curvature at the bilayer interface. Net zero curvature is more readily achieved when the head group of an amphiphile (or group of amphiphiles) and the tail moiety of a amphiphile (or group of amphiphiles) occupy equal or nearly equal volume areas. When the head group and tail moiety area volumes are nearly equal, there is no driving force to cause the surfactant interface to curve in either direction and then the surfactant interface becomes bicontinuous (Surfactants and Interfacial Phenomena, Second Edition, M. J. Rosen). Often cosurfactants are used to make oil in water bicontinuous microemulsions (Surfactants and Interfacial Phenomena, Second Edition, M. J. Rosen). A similar principle operates with fabric softener bilayers. Diquats, by their very nature have large head groups because the two charged amine moieties are both very water miscible and therefore, it is helpful to have a principal solvent that can migrate to the interface acting to 'fill in' for the tail volume, to achieve zero curvature necessary to drive the system into the isotropic bicontinuous phase. Bilayer modifiers can also act as 'fillers' that together with the fabric softener active push the system into a state of zero curvature necessary to drive the system into the isotropic bicontinuous phase. With the appropriate bilayer modifier, the principal solvent or organic solvent can be substantially reduced even to the point, in some cases, of surprisingly eliminating the need to add solvent that is not a part of the polyquaternary, preferably diquaternary, ammonium fabric softening active raw material because the solvent is only necessary to break the water structure and no longer necessary to act as a filler at the fabric softener bilayer surface. Unsaturation and/or branching in the components improves flexibility, thus facilitating the bending of the surface of the bilayer, when necessary.

Bilayer modifiers are highly desired optional components of clear compositions with low solvent or zero added solvent. Preferably these compounds are amphiphilic with a water miscible head group attached to a hydrophobic moiety.

Non-limiting examples of suitable bilayer modifiers include:

i) mono-alkyl cationic amines having the formula:

$$[RN^+(R^1)_3]X^-$$

wherein R is $C_8$–$C_{22}$ alkyl, preferably $C_{10}$–$C_{18}$ alkyl; $C_8$–$C_{22}$ alkenyl, preferably $C_{10}$–$C_{18}$ alkenyl; and mixtures thereof. Each $R^1$ is hydrogen, $C_1$–$C_6$ alkyl, $C_1$–$C_6$ substituted alkyl wherein said substitution is, inter alia, —OH, —$SO_3M$, —$CO_2M$, wherein M is a water soluble cation; benzyl, a polyalkyleneoxy unit having the formula:

$$—(R^2O)_xR^3$$

wherein $R^2$ is ethylene, 1,2-propylene, and mixtures thereof, $R^3$ is hydrogen of $C_1$–$C_4$ alkyl, x has the average value of form 2.5 to about 20, preferably 3 to about 10; X is a fabric softener compatible anion.

Examples of preferred mono-alkyl cationic amines are Adogen 461® Varisoft 417®, and Varisoft 471® ex Witco, and Armeen® Z ex Akzo Nobel.

Included in this class of compounds are the $C_8$–$C_{22}$ alkyl choline esters having the formula:

$$[RC(O)OCH_2CH_2N^+(R^1)_3]X^-$$

wherein R is $C_8$–$C_{22}$ alkyl, preferably $C_{10}$–$C_{18}$ alkyl; $C_8$–$C_{22}$ alkenyl, preferably $C_{10}$–$C_{18}$ alkenyl; and mixtures thereof. Each $R^1$ is hydrogen, $C_1$–$C_6$ alkyl, $C_1$–$C_6$ substituted alkyl wherein said substitution is, inter alia, —OH, —$SO_3M$, —$CO_2M$, wherein M is a water soluble cation; benzyl, a polyalkyleneoxy unit having the formula:

$$—(R^2O)_xR^3$$

wherein $R^2$ is ethylene, 1,2-propylene, and mixtures thereof, $R^3$ is hydrogen of $C_1$–$C_4$ alkyl, x has the average value of form 2.5 to about 20, preferably 3 to about 10; X is a fabric softener compatible anion. Suitable examples of choline esters can be found in U.S. Pat. No. 4,840,738 Hardy et al., issued Jun. 20, 1989 and incorporated herein by reference.

ii) polar and non-polar hydrophobic oils, non-limiting examples of which include, dioctyl adipate: Wickenol® 158 ex Alzo Inc, oleyl oleate: Dermol® OLO ex Alzo Inc. emollients such as fatty esters, e.g. methyl oleates, Wickenols®, derivatives of myristic acid such as isopropyl myristate, and triglycerides such as canola oil; free fatty acids such as those derived from canola oils, fatty alcohols such as oleyl alcohol, bulky esters such as benzyl benzoate and benzyl salicylate, diethyl or dibutyl phthalate; bulky alcohols or diols; and perfume oils particularly low-odor perfume oils such as linalool; mono or poly sorbitan esters; and/or mixtures thereof.

Non-polar hydrophobic oils can be selected from petroleum derived oils such as hexane, decane, pentadecane, dodecane, isopropyl citrate and perfume bulky oils such as limonene, and/or mixtures thereof. In particular, the free fatty acids such as partially hardened canola oil can provide increased softness benefits.

iii) nonionic surfactants selected from the group consisting of alkyl amide alkoxylated nonionic surfactants, alkylaryl nonionic surfactants, alkyl nonionic alkoxylated surfactants, alkoxylated nonionic surfactants comprising bulky head groups, non-alkoxylated nonionic surfactants comprising bulky head groups, block co-polymers obtained by co-polymerization of ethylene oxide and propylene oxide, and mixtures thereof.

a) alkylamide alkoxylated nonionic surfactants. A non-limiting example of an alkyl amide alkoxylated nonionic surfactant suitable for use in the present invention has the formula:

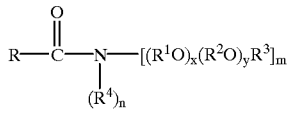

wherein R is $C_7$–$C_{21}$ linear alkyl, $C_7$–$C_{21}$ branched alkyl, $C_7$–$C_{21}$ linear alkenyl, $C_7$–$C_{21}$ branched alkenyl, and mixtures thereof.

$R^1$ is ethylene; $R^2$ is $C_3$–$C_4$ linear alkyl, $C_3$–$C_4$ branched alkyl, and mixtures thereof; preferably $R^2$ is 1,2-propylene. Nonionic surfactants which comprise a mixture of $R^1$ and $R^2$ units preferably comprise from about 4 to about 12 ethylene units in combination with from about 1 to about 4 1,2-propylene units. The units may be alternating, or grouped together in any combination suitable to the formulator. Preferably the ratio of $R^1$ units to $R^2$ units is from about 4:1 to about 8:1. Preferably an $R^2$ units (i.e. 1,2-propylene) is attached to the nitrogen atom followed by the balance of the chain comprising from 4 to 8 ethylene units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent and is instead replaced by a —$[(R^1O)_x(R^2O)_yR^3]$ unit.

The index m is 1 or 2, the index n is 0 or 1, provided that when in is equal to 1, n is equal to 1; and when m is 2 n is 0; preferably m is equal to 1 and n is equal to one, resulting in one —$[(R^1O)_x(R^2O)_yR^3]$ unit and $R^4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all of the alkyleneoxy units are ethyleneoxy units. Those skilled in the art of ethoxylated polyoxyalkylene alkyl amide surface active agents will recognized that the values for the indices x and y are average values and the true values may range over several values depending upon the process used to alkoxylate the amides.

Suitable means for preparing the polyoxyalkylene alkylamide surface active agents of the present invention can be found in "Surfactant Science Series", Editor Martin Schick, Volume I, Chapter 8 (1967) and Volume XIX, Chapter 1 (1987) included herein by reference. Examples of suitable ethoxylated alkyl amide surfactants are Rewopal® $C_6$ from Witco, Amidox® C5 ex Stepan, and Ethomid® O/17 and Ethomid® HT/60 ex Akzo.

b) Alkyl Nonionic Surfactants:

Suitable alkyl alkoxylated nonionic surfactants with amine functionality are generally derived from saturated or unsaturated, primary, secondary, and branched fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having≦about 50 moles alkylene oxide moieties (e.g. ethylene oxide and/or propylene oxide) per mole of amine. The amine or amine-oxide surfactants for use herein have at least one hydrophobe with from about 6 to about 22 carbon atoms, and are in either straight chain and/or branched chain configuration, preferably there is one hydrocarbon in a straight chain configuration having about 8 to about 18 carbon atoms with one or two alkylene oxide chains attached to the amine moiety, in average amounts of≦50 about moles of alkylene oxide per amine moiety, more preferably from about 5 to about 15 moles of alkylene oxide, and most preferably a single alkylene oxide chain on the amine moiety containing from about 8 to about 12 moles of alkylene oxide per amine moiety. Preferred materials of this class also have pour points about 70° F. and/or do not solidify in these clear formulations. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Suitable alkyl alkoxylated nonionic surfactants are generally derived from saturated or unsaturated primary, secondary, and branched fatty alcohols, fatty acids, alkyl phenols, or alkyl aryl (e.g., benzoic) carboxylic acid, where the active hydrogen(s) is alkoxylated with≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in either straight chain or branched chain configuration, preferably straight chain configurations having from about 8 to about 18 carbon atoms, with the alkylene oxide being present, preferably at the primary position, in average amounts of≦about 30 moles of alkylene oxide per alkyl chain, more preferably from about 5 to about 15 moles of alkylene oxide, and most preferably from about 8 to about 12 moles of alkylene oxide. Preferred materials of this class also have pour points of about 70° F. and/or do not solidify in these clear formulations. Examples of alkyl alkoxylated surfactants with straight chains include Neodol® 91-8, 25-9, 1-9, 25-12, 1-9, and 45-13 from Shell, Plurafac® B-26 and C-17 from BASF, and Brij® 76 and 35 from ICI Surfactants. Examples of branched alkyl alkoxylated surfactants include Tergitol® 15-S-12, 15-S-15, and 15-S-20 from Union Carbide and Emulphogene® BC-720 and BC-840 from GAF. Examples of alkyl-aryl alkoxylated surfactants include Igepal® CO-620 and CO-710, from Rhone Poulenc, Triton® N-111 and N-150 from Union Carbide, Dowfax® 9N5 from Dow and Lutensol® AP9 and AP14, from BASF. A preferred ethoxylated nonionic surfactant is NEODOL 91-8 ex Shell.

c) Nonionic Surfactants Comprising Bulky Head Groups. Suitable alkoxylated and non-alkoxylated phase stabilizers with bulky head groups are generally derived from saturated or unsaturated, primary, secondary, and branched fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having≦about 50, preferably≦about 30, moles per heterocyclic or carbohydrate head group. The hydrocarbon groups on the carbohydrate or heterocyclic surfactant for use herein have from about 6 to about 22 carbon atoms, and are in either straight chain and/or branched chain configuration. Preferably there is one hydrocarbon having from about 8 to about 18 carbon atoms with one or two alkylene oxide chains carbohydrate or heterocyclic moiety with each alkylene oxide chain present in average amounts of≦about 50, preferably≦about 30, per carbohydrate or heterocyclic moiety, more preferably from about 5 to about 15 moles of alkylene oxide per alkylene oxide chain, and most preferably between about 8 and about 12 moles of alkylene oxide total per surfactant molecule including alkylene oxide on both the hydrocarbon chain and on the heterocyclic or carbohydrate moiety. Examples of phase stabilizers in this class are Tween® 40, 60, and 80 available from ICI Surfactants.

d) Block Co-Polymers

Suitable polymers include a copolymer having blocks of terephthalate and polyethylene oxide. More specifically, these polymers are comprised of repeating units of ethylene and/or propylene terephthalate and polyethylene oxide terephthalate at a preferred molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymer is in the range of from about 5,000 to about 55,000.

Another preferred polymer is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon® 4780 (from DuPont) and Milease® T (from ICI).

The following is a non-limiting example of a cationic charge booster system according to the present invention.

EXAMPLE 1

Preparation of N,N,N',N'-tetra(2-hydroxyethyl) hexylenediamine

N,N-Diethanolamine (1331.3 g, 11.36 mol) is placed in a 5000 ml three-necked round bottomed flask fitted with a condenser, addition funnel, internal thermometer, mechanical stirrer and argon inlet. 1,6-Dibromohexane (1386 g, 5.68 mol) is added via the addition funnel slowly to keep the reaction temperature below 60° C. After addition is completed the mixture is heated to 55–60° C. for 18 h. The reaction mixture is poured into a 6 L Erlenmeyer flask containing a solution of methanol (1.5 L) and sodium hydroxide (227.2 g, 5.68 mol). White salts begin to precipitate. After 4 h, the mixture is filtered. The filtrate is concentrated under reduced pressure to leave the product as a viscous oil.

Step (1)

Acylation of Di-Amine with Canola Fatty Acid

Canola fatty acid (136.27 g, 0.482 mol) and toluene (350 mL) are placed in a 3000 mL round-bottomed flask fitted with a condenser, magnetic stirrer, argon inlet and Dean-Stark trap. The solution is sparged for 30 minutes. N,N,N',N'-tetra(2-hydroxyethyl)-hexylenediamine (70.4 g, 0.241 mol), butylated hydroxytoluene (0.36 g, 1.60 mmol, BHT) and p-toluenesulfonic acid (0.63 g, 3.20 mmol) are added to the reaction flask. The mixture is heated to reflux for 48 h. Solvent is removed under reduced pressure to form an acylated di-amino admixture.

Step (2)

Quaternization of Acylated Di-Amino Admixture

The entire acylated di-amino admixture is combined with acetonitrile (350 mL) in a 3000 mL round-bottomed flask fitted with condenser, magnetic stirrer and argon inlet. Dimethyl sulfate (43.32 g, 0.344 mol) is added to the reaction flask. The mixture is heated for 18 h and cooled. The solvent is removed under reduced pressure to form a cationic charge booster system.

The following compositions illustrate the present invention.

| | Weight % | | | |
|---|---|---|---|---|
| Ingredients | 2 | 3 | 4 | 5 |
| DEQA [1] | 26.0 | 25.7 | 26.0 | 30.0 |
| Charge Booster System [2] | 2.0 | 1.0 | 2.0 | 2.4 |
| Ethanol | 2.2 | 2.4 | 2.2 | 2.6 |
| Hexylene glycol | 2.6 | 2.3 | 2.6 | 2.6 |
| 1,2-Hexanediol | 17.0 | — | 17.0 | — |
| TMPD [3] | — | 11.9 | — | 12.0 |
| CHDM [4] | — | 5.0 | — | 48.1 |
| Water | 52.5 | 53.6 | 52.5 | 48.1 |
| Minors [5] | balance | balance | balance | balance |

[1] N,N-di(canoyloxyethyl)-N-2-hydroxyethyl-N-methyl ammonium methyl sulfate available from Witco.
[2] Diquat admixture according to Example 1.
[3] Trimethyl pentanediol available from Eastman Chemical.
[4] 1,4-cyclohexane dimethanol available from Eastman Chemical.
[5] Minors can include perfume, dye, acid, preservatives, etc.

What is claimed is:

1. A fabric softener composition comprising:

a) from about 2% by weight, of a fabric softening active;

b) from about 0.2% by weight, of a cationic charge boosting system, said cationic charge boosting system comprising an admixture of two or more diamino compounds selected from:

i) one or more diamines having the formula:

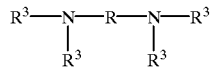

ii) one or more quaternary ammonium compounds having the formula:

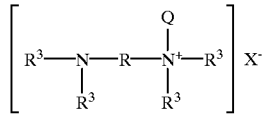

iii) one or more di-quaternary ammonium compounds having the formula:

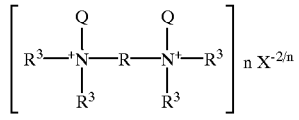

wherein R is $C_2$-$C_{12}$ alkylene; each $R^3$ is independently $R^1$, an acyl comprising unit having the formula:

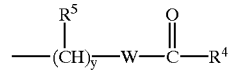

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; and mixtures thereof; each $R^5$ is independently hydrogen, —OH, —$NH_2$, —$(CH_2)_2WC(O)R^4$, and mixtures thereof; Q is a quaternizing unit selected from the group consisting of $C_1$–$C_{12}$ alkyl, benzyl, and mixtures thereof; W is —O—, —NH—, and mixtures thereof; X is a water soluble cation; the index n is 1 or 2; y is from 2 to 6; z is from 0 to 4; y+z is less than 7;

provided at least one of said diamino compounds is a di-quaternary ammonium compound; and c) the balance carriers and other adjunct ingredients.

2. A composition according to claim 1 wherein said fabric softening active is selected from the group consisting of:

i) an amine having the formula:

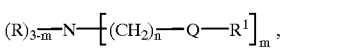

ii) a quaternary ammonium compound having the formula:

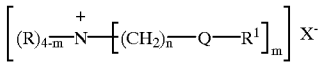

iii) and mixtures thereof;

wherein each R is independently $C_1$–$C_6$ alkyl, $C_1$–$C_6$ hydroxyalkyl, benzyl, and mixtures thereof; $R^1$ is $C_{11}$–$C_{22}$ linear alkyl, $C_{11}$–$C_{22}$ branched alkyl, $C_{11}$–$C_{22}$ linear alkenyl, $C_{11}$–$C_{22}$ branched alkenyl, and mixtures thereof; Q is a carbonyl moiety independently selected from units having the formula:

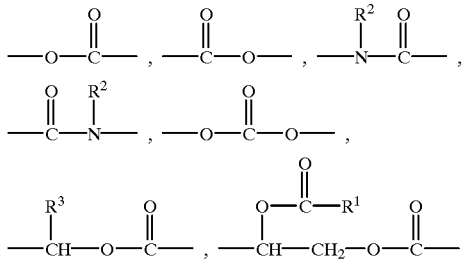

wherein $R^2$ is hydrogen, $C_1$–$C_4$ alkyl, and mixtures thereof; $R^3$ is hydrogen, $C_1$–$C_4$ alkyl, and mixtures thereof; X is a water soluble anion; the index m has the value from 1 to 3, the index n has the value from 1 to 4.

3. A composition according to claim 2 wherein Q has the formula:

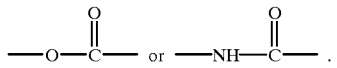

4. A composition according to claim 3 wherein R is methyl, ethyl, hydroxyethyl, benzyl, and mixtures thereof.

5. A composition according to claim 4 wherein n is equal to 2.

6. A composition according to claim 2 wherein the moiety —Q—$R^1$ comprises an acyl unit, said acyl unit derived from a source of triglyceride selected from the group consisting of tallow, hard tallow, lard, coconut oil, partially hydrogenated coconut oil, canola oil, partially hydrogenated canola oil, safflower oil, partially hydrogenated safflower oil, peanut oil, partially hydrogenated peanut oil, sunflower oil, partially hydrogenated sunflower oil, corn oil, partially hydrogenated corn oil, soybean oil, partially hydrogenated soybean oil, tall oil, partially hydrogenated tall oil, rice bran oil, partially hydrogenated rice bran oil, synthetic triglyceride feedstocks and mixtures thereof.

7. A composition according to claim 6 wherein said source of triglyceride is tallow, hard tallow, coconut oil, partially hydrogenated coconut, canola oil, hydrogenated canola oil, synthetic triglyceride feedstocks, and mixtures thereof.

8. A composition according to claim 1 wherein R of said cationic charge boosting system is $C_2$–$C_8$ alkylene.

9. A composition according to claim 1 wherein R of said cationic charge boosting system is $C_6$ alkylene.

10. A composition according to claim 1 wherein at least two $R^3$ units of said cationic charge boosting system are acyl comprising units.

11. A composition according to claim 1 wherein y of said cationic charge boosting system is equal to 2.

12. A composition according to claim 1 wherein $R^4$ of said cationic charge boosting system is $C_{12}$–$C_{18}$ linear or branched alkyl, $C_{12}$–$C_{18}$ linear or branched alkenyl, and mixtures thereof.

13. A composition according to claim 1 wherein Q of said cationic charge boosting system is methyl.

14. A composition according to claim 1 wherein two $R^3$ units of said cationic charge boosting system are 2-hydroxyethyl.

15. A fabric softener composition comprising:

a) from about 2% by weight, of a fabric softening active;

b) from about 0.2% by weight, of a cationic charge boosting system wherein said cationic charge boosting system comprises an admixture of di-amino compounds formed from the process comprising the steps of:

i) reacting one equivalent of a diamine having the formula:

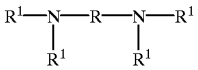

wherein R is $C_2$–$C_{12}$ alkylene; each $R^1$ is independently hydrogen, $C_1$–$C_4$ alkyl, a unit having the formula:

—$R^2$—Z wherein $R^2$ is $C_2$–$C_6$ linear or branched alkylene, $C_2$–$C_6$ linear or branched hydroxy substituted alkylene, $C_2$–$C_6$ linear or branched amino substituted alkylene, and mixtures thereof; Z is hydrogen, —OH, —$NH_2$, and mixtures thereof; with from about 0.1 equivalent to about 8 equivalents of an acylating agent to form an acylated di-amino admixture; and ii) reacting said acylated di-amino admixture with from 0.1 equivalents to 2 equivalents of a quaternizing agent to form a cationic charge booster system; and c) the balance carriers and other adjunct ingredients.

16. A composition according to claim 15 wherein $R^1$ has the formula:

—$(CH_2CH_2)$—Z and wherein greater than 50% of said admixture comprises di-quaternary amino compounds.

17. A composition according to claim 15 wherein said diamine from step (i) has the formula:

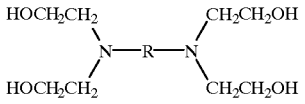

wherein R is $C_2$–$C_6$ alkylene.

18. A composition according to claim 15 wherein said acylating agent from step (i) is selected from the group consisting of:

a) acyl halides having the formula:

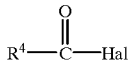

b) an ester having the formula:

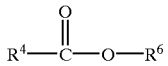

c) anhydrides having the formula:

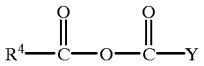

d) carboxylic/carbonic anhydrides having the formula:

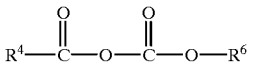

e) acyl azides having the formula:

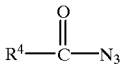

f) and mixtures thereof;

wherein $R^4$ is $C_6$–$C_{22}$ linear or branched, substituted or unsubstituted alkyl, $C_6$–$C_{22}$ linear or branched, substituted or unsubstituted alkenyl, or mixtures thereof; Hal is a halogen selected from chlorine, bromine, or iodine; $R^6$ is $R^4$, $C_1$–$C_5$ linear or branched alkyl; Y is $R^4$, —$CF_3$, —$CCl_3$, and mixtures thereof.

* * * * *

UNITED STATES PATENT AND TRADEMARK OFFICE

CERTIFICATE OF CORRECTION

PATENT NO. : 6,211,140 B1
DATED : April 3, 2001
INVENTOR(S) : Mark Robert Sivik et al.

It is certified that error appears in the above-identified patent and that said Letters Patent is hereby corrected as shown below:

Column 22, claim 1,
Line 60 should read:

"…. $R^1$, wherein $R^1$ is independently hydrogen, $C_1$-$C_4$ alkyl, a unit having the formula:

$$— R^2\text{-}Z$$

wherein $R^2$ is $C_2$-$C_6$ linear or branched alkylene, $C_2$-$C_6$ linear or branched hydroxy substituted alkylene, $C_2$-$C_6$ linear or branched amino substituted alkylene, and mixtures thereof; Z is hydrogen, -OH, $-NH_2$, and mixtures thereof; an acyl comprising unit having the formula: ……"

Signed and Sealed this

Fifteenth Day of January, 2002

*Attest:*

*Attesting Officer*

JAMES E. ROGAN
*Director of the United States Patent and Trademark Office*